United States Patent [19]

Tremoulet, Jr. et al.

[11] Patent Number: 4,754,526

[45] Date of Patent: Jul. 5, 1988

[54] SYSTEM INCLUDING A MULTI-STEPPED NOZZLE ASSEMBLY FOR BACK-BORING AN INGROUND PASSAGEWAY

[75] Inventors: Olivier L. Tremoulet, Jr., Edmonds; Kenneth E. Fender; Andrew A. Burns, both of Seattle, all of Wash.

[73] Assignee: FlowMole Corporation, Kent, Wash.

[21] Appl. No.: 946,537

[22] Filed: Dec. 24, 1986

[51] Int. Cl.[4] ..... E21B 10/60; E21B 10/26

[52] U.S. Cl. ..... 175/424; 175/391; 175/393

[58] Field of Search ..... 175/65, 53, 67, 391, 175/393, 424, 406, 339, 340; 299/17, 81

[56] References Cited

U.S. PATENT DOCUMENTS

| | | | |
|---|---|---|---|
| 2,149,798 | 3/1939 | Starkey | 175/391 |
| 2,607,562 | 8/1952 | Phipps | 175/391 |
| 2,720,381 | 10/1955 | Quick . | |
| 2,785,875 | 3/1957 | Hayes . | |
| 2,837,324 | 6/1958 | Aschacker | 175/53 |
| 3,066,735 | 12/1962 | Zingg . | |
| 3,123,159 | 3/1964 | Buck | 175/67 |
| 3,324,957 | 6/1967 | Goodwin et al. | 175/67 |
| 3,386,521 | 6/1968 | Chadderdon et al. | 175/269 |
| 3,417,829 | 12/1968 | Acheson et al. | 175/67 |
| 3,467,211 | 9/1969 | Goodwin et al. | 175/422 |
| 3,881,561 | 5/1975 | Pols et al. | 175/393 |
| 3,967,689 | 7/1976 | Cherrington | 175/53 |
| 4,031,971 | 6/1977 | Miller | 175/424 |

*Primary Examiner*—Stephen J. Novosad
*Assistant Examiner*—Bruce M. Kisliuk
*Attorney, Agent, or Firm*—Flehr, Hohbach, Test, Albritton & Herbert

[57] ABSTRACT

A nozzle assembly for enlarging an inground passageway produced by, for example, a boring device is disclosed herein. The nozzle assembly is comprised of a longitudinally extending nozzle body defining an interior cavity adapted to receive fluid under pressure from an external source and at least one arrangement of outwardly facing adjacent stepped surfaces which provide longitudinally spaced cutting jets directed normal to the movement of the boring device and nozzle assembly as the latter moves through a previously provided passageway in order to progressively enlarge the passageway.

21 Claims, 2 Drawing Sheets

SYSTEM INCLUDING A MULTI-STEPPED NOZZLE ASSEMBLY FOR BACK-BORING AN INGROUND PASSAGEWAY

The present invention relates generally to techniques for providing inground passageways for telephone lines, power conduits and the like, and more particularly to a specifically designed nozzle assembly especially suitable for use in combination with a boring device to enlarge an inground passageway previously produced by the boring device.

One way in which inground passageways are provided for purposes of installing buried utilities is described in U.S. patent application Ser. No. 709,046, filed Mar. 7, 1985 now U.S. Pat. No. 4,674,579. In that application, which is assigned to the assignee of the present application and which is incorporated herein by reference, a specifically designed boring device is illustrated. This boring device is connected to a source of fluid under pressure and uses that source to provide a series of cutting jets for boring out an inground passageway as the device is moved through the ground. While the boring device is perfectly satisfactory for its intended function which is to provide inground passageways, in some applications, the initially provided passageway is not sufficiently large diametrically to contain all of the desired utility lines and conduits. As a result, applicants have found it necessary to back-ream or otherwise enlarge the passageway, preferably by means of the same type of water jet action used to produce the passageway in the first place. However, when a water jet operates submerged in an incompressible fluid (i.e., the passageway as it fills with water from the jets), the energy of the water jets is quickly transferred through turbulent mixing to the surrounding fluid. This severely limits the effective cutting distance of the jet. Accordingly, in order to cut hard soil such as California clay, applicants have found it to be necessary to place the cutting nozzle as close as possible to the material being cut.

It is therefore an object of the present invention to provide a system including a nozzle assembly for back-boring a passageway and specifically a nozzle assembly designed to place a series of fluid cutting jets as close as possible to the sidewalls of the passageway without disrupting the cutting action.

As will be seen hereinafter, the nozzle assembly disclosed herein includes a longitudinally extending nozzle body adapted for coaxial connection with a drill train or other suitable means for pushing and/or pulling the nozzle body and for connecting it to a source of fluid under pressure. The nozzle body defines an interior cavity adapted to receive fluid under pressure passing through, for example, the drill train, from the external source just mentioned. The nozzle body also includes at least one group of outwardly facing adjacent stepped surfaces including first surfaces facing in a direction perpendicular to and located progressively further from the longitudinal axis of the nozzle body starting with the first surface closest to the front longitudinal end of the body and second surfaces, each of which is perpendicular to and directly behind an associated first surface. At least one orifice extends through each of the first surfaces of each step and into the interior cavity of the nozzle body whereby all of the orifices together provide a plurality of longitudinally spaced fluid cutting jets perpendicular to the longitudinal axis of the nozzle body when the cavity itself contains fluid under pressure. In this way, the nozzle assembly can be used for progressively enlarging an inground passageway, for example, one previously made by a boring device or by other such means, by moving the jet providing nozzle body in a longitudinally extending forward direction through the passageway while the jet body and therefore the jets themselves are rotated about the axis of the jet body.

The present invention will be described in more detail below in conjunction with the drawings wherein:

FIG. 1 diagrammatically illustrates an overall system including a nozzle assembly designed in accordance with the present invention and especially suitable for enlarging an already existing inground passageway;

Figure 1:
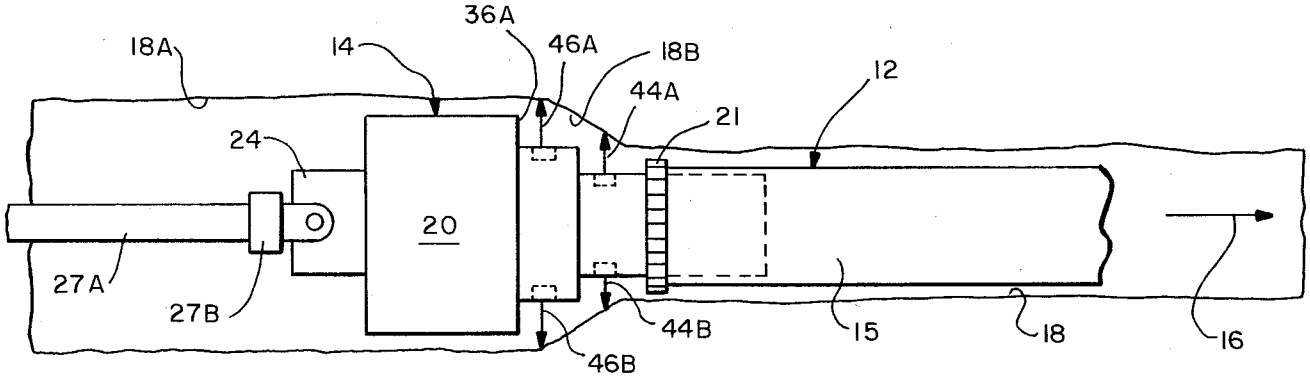

Turning now to the drawings, wherein like components are designated by like reference numerals throughout the various figures, attention is first directed to FIG. 1. This figure illustrates an overall boring apparatus or system which is generally indicated by the reference numeral 12 and which includes a nozzle assembly 14 designed in accordance with one embodiment of the present invention and means generally indicated at 15 for pulling the nozzle assembly in the direction of arrow 16 through a passageway 18. In FIG. 1 means 15 is a drill string of the type illustrated in the above-recited U.S. patent application Ser. No. 709,046. The drill train couples an external source of fluid under pressure to nozzle 14 in the manner described in the application and, at the same time, pulls it in a forward direction through previously provided inground passageway 18, as indicated by arrow 16. In an actual working embodiment of the present invention, the passageway is first made by a boring device of the type described in the above-recited patent application. As will be seen immediately below, nozzle assembly 14 thereafter enlarges the passageway diametrically, as indicated at 18A in FIG. 1.

Figure 4:
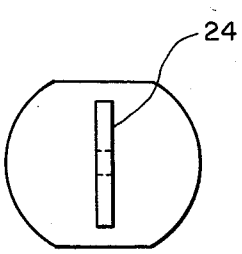
FIG. 4 is a back plan view of the nozzle assembly illustrated in FIGS. 2 and 3.
Figure 3:
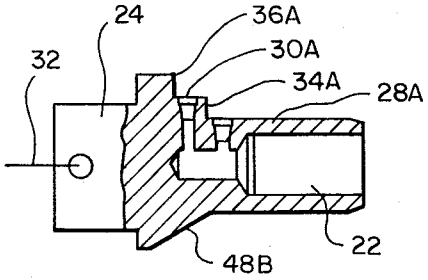
FIG. 3 is a sectional view of the nozzle assembly of FIG. 2, taken generally along line 3—3 in FIG. 2.
Figure 2:
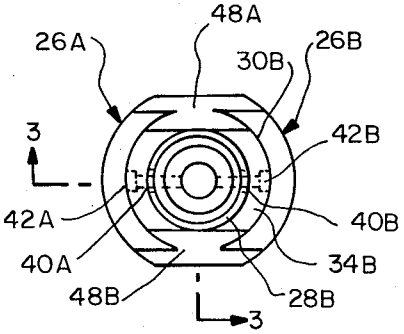
FIG. 2 is the frontal plan view of a nozzle assembly designed in accordance with a first embodiment of the present invention.

Still referring to FIG. 1, in conjunction with FIGS. 2–4, nozzle assembly 14 is shown including a longitudinally extending nozzle body 20 axially connected at its front longitudinal end to one end of drill string 12 by suitable coupling means generally indicated at 21. Nozzle body 20 defines an interior cavity 22 (see FIG. 3) which is adapted to receive fluid under pressure passing through the drill string from an external source (not shown). As will be seen below, cavity 22 is in fluid communication with a number of orifices extending through the nozzle body so as to provide a series of cutting jets for enlarging passageway 18. To this end, drill string 12 is rotated about its own axis and pulled through passageway 18 in the direction of arrow 16 by suitable pulling and rotating means (not shown) which, in turn, pulls nozzle assembly 14 with it. As the fluid cutting jets exit the nozzle body in the manner to be described they progressively enlarge passageway 18, as indicated at 18A.

Figure 5:
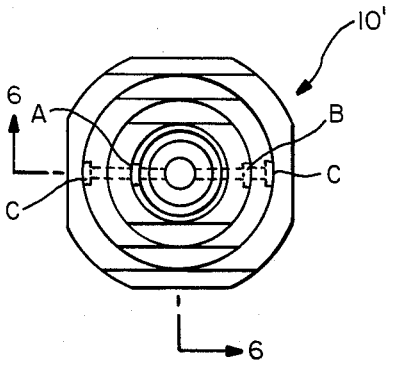
FIG. 5 is a frontal plan view of a nozzle assembly designed in accordance with a second embodiment of the present invention.

As indicated above, nozzle assembly 14 is connected to one end of drill string 12 or other suitable push/pull-/rotating means. As also indicated above, drill train 12 may be of the type disclosed in patent application Ser. No. 709,046. In FIG. 5 of this latter patent application, a different type of reaming device is shown coupled to the drill train by means of a female coupling and cooperating nut. Nozzle body 20 can be connected to the drill string or other such push/pull/rotating means 12 in the same manner such that the external pressurized fluid source is connected to cavity 22 through the push/pull-/rotating means. In any case, the back end of nozzle body 20 may include a suitable connecting flange 24 for connecting the nozzle assembly to one end of a cable 27A. In that way, as the nozzle assembly is pulled through passageway 16 for enlarging the latter it will simultaneously pull cable 27A into position within the enlarged passageway. To this end, the cable is connected to tab 24 of the nozzle assembly by means of a swivel 27B which accommodates for the rotation of the nozzle assembly.

Turning specifically to FIGS. 2, 3 and 4, nozzle assembly 14 is shown including two arrangements 26A and 26B of outwardly facing adjacent stepped surfaces on opposite sides of nozzle body 20. Arrangement 26A consists of two steps including first surfaces 28A, 30A facing in the direction perpendicular to and located progressively further from the longitudinal axis 32 of nozzle body 20 (see FIG. 3) starting with the first surface closest to the front longitudinal end of the nozzle body, that is, surface 28A. The two steps also include second surfaces 34A and 36A, each of which is perpendicular to and directly behind an associated first surface. Arrangement 26B consists of identical steps on the opposite side of nozzle body 20 and longitudinally aligned with the steps of arrangement 26A. Note particularly in FIG. 2 that the stepped surfaces forming part of arrangement 26B correspond in reference numerals to the step surfaces of arrangement 26A with the reference letters A and B distinguishing the stepped surfaces forming part of arrangement 26A from the stepped surfaces forming part of arrangement 26B. Note also that each of the stepped surfaces lies on a circle concentric with the longitudinal axis 32 of nozzle body 20.

As indicated previously, nozzle assembly 14 includes a series of orifices extending through nozzle body 20 and into cavity 22 in order to provide fluid cutting jets. As best illustrated in FIGS. 2 and 3, each of the stepped surfaces facing in a direction perpendicular to longitudinal axis 32, that is, the stepped surfaces 28 and 30 include orifices 40A,B and 42A,B positioned in the center of the surfaces, whereby to provide outwardly directed cutting jets perpendicular to axis 32 and therefore perpendicular to the axis of passageway 16. These cutting jets are shown at 44A,B and 46A,B in FIG. 1 diagrammatically by means of arrows.

Note particularly from FIG. 1 that the cutting jets 44A and 44B which are closer to the front end of nozzle body 20 are also closer to the longitudinal axis of the nozzle body than cutting jets 46. In this way, as the nozzle assembly is moved in a forward direction through passageway 16, the forwardmost cutting jets serve to enlarge the passageway an amount sufficient to allow the next step including cutting jets 46 to pass therethrough. These cutting jets then further enlarge the passageway, as shown in FIG. 1. Where it is desirable to have even larger passageway, nozzle assembly 14 can be provided with a greater number of steps, as shown in the embodiments in FIGS. 5–7 to be discussed briefly hereinafter. In the case of a greater number of steps, each successive is shown including its own cutting jets which progressively enlarge passageway 16 in order to allow the next adjacent step to enter the passageway. In a preferred embodiment, the nozzle assembly is rotated about its longitudinal axis as it moves through passageway 16, thereby rotating the cutting jets at the same time. This may be accomplished by motor means at the rearward end of the drill train as described in the above-recited U.S. patent application.

Still referring to FIGS. 2–4, nozzle body 20 is shown including opposing flat surfaces 48A and 48B on opposite sides of the nozzle body between step arrangements 26A and 26B. As seen in FIGS. 2 and 3, each of these surfaces tapers outwardly and rearwardly from a forward longitudinal point to a rearward longitudinal point on the nozzle body. These tapered surfaces serve to allow passage of cutting spoils for the enlarged hole as the nozzle assembly moves through passageway 16. In this regard, an important design feature of the overall nozzle assembly relates to the position of each cutting jet (and therefore each orifice) relative to the adjacent surface forming part of its step, that is, surface 34A,B in the case of jet 44 and surface 36A,B in the case of jet 46. More specifically, the distance between these jets and adjacent surfaces must be small enough to minimize the possibility of material building up behind the jet and large enough to allow a reasonable advance with each revolution of the nozzle assembly. In an actual working embodiment, this distance, measuring from the center of the orifice is about ⅜". Also, the material making up these latter surfaces 34 and 36 are preferably hard, wear-resistant material, for example a tungsten carbide hard facing.

Figure 6:
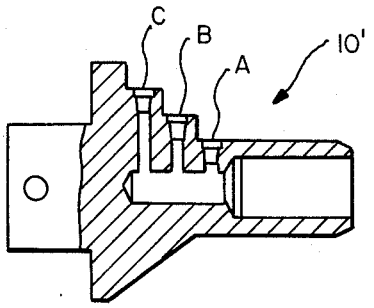
FIG. 6 is a sectional view of the nozzle assembly of FIG. 5, taken generally along line 6—6 in FIG. 5.
Figure 7:
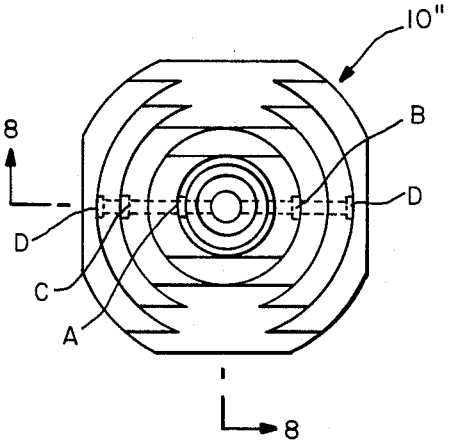
FIG. 7 is a frontal plan view of a nozzle assembly designed in accordance with a third embodiment of the present invention.
Figure 8:
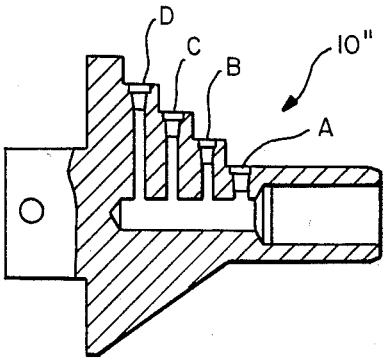
FIG. 8 is a sectional view of the nozzle assembly illustrated in FIG. 7, taken generally along the line 8—8 in FIG. 7.

Referring to FIGS. 5 and 6, the nozzle assembly 10' designed in accordance with a second embodiment of the present invention is illustrated. This assembly is identical to assembly 10, except that it includes opposing step arrangements on opposite sides of the nozzle assembly, each arrangement consisting of three steps and therefore three apertures and a corresponding number of fluid cutting jets. FIGS. 7 and 8 illustrate a nozzle assembly 10" designed in accordance with a third embodiment of the present invention which, like assembly 10' may be identical to assembly 10, except for the number of steps making up its stepping arrangements. Assembly 10" includes four steps on each side of its nozzle body and four surfaces and a corresponding number of cutting jets. In this latter regard, it is to be noted that each step on each side of the nozzle body in each of the embodiments illustrated, a single orifice has been provided. It is to be understood that each step could include more than one orifice. For example, in the case of assembly 10, step surface 28A could include two or more orifices 40A and a corresponding number of cutting jets 44A.

In each of the nozzle assembly embodiments described above, the nozzle body included two steps, each of which included its orifice and corresponding fluid cutting jet. Also, in each of these embodiments, the rearwardmost step included a rearwardmost second surface directly behind the last cutting jet. For example, in FIG. 3, the surface 36A is located behind the last cutting jet 46A (see FIG. 1). Note that the outwardly facing surface extending rearwardly from surface 36A does not itself include a cutting jet. This is also true for embodiments 10' and 10''. As a result, surface 36A in embodiment 10 and each of the corresponding surfaces in embodiments 10' and 10'' serve as a drag against the outer wall of passageway 18 as the nozzle assembly is pulled therethrough. If this last shouldered surface were not present or if a cutting jet were located on the outwardly facing surface behind it, there would be virtually no drag friction and the operator might and quite possibly would pull the entire nozzle assembly through passageway 18 too rapidly. This last shouldered surface 36A in the case of assembly 10 and each of the corresponding surfaces in the other embodiments serve as a drag to prevent this. This is best illustrated in FIG. 1. Note that as the nozzle assembly is pulled forward in the direction of arrow 16, the top surface 36A will tend to drag against the tapered section 18B of passageway 18.

Figure 9:
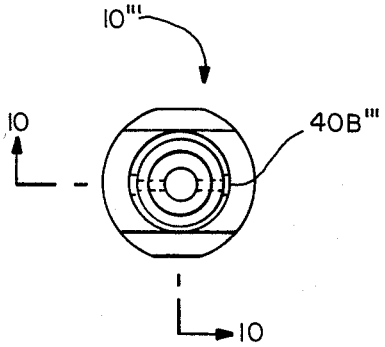
FIG. 9 is a frontal plan view of a nozzle assembly designed in accordance with a fourth embodiment of the present invention.
Figure 10:
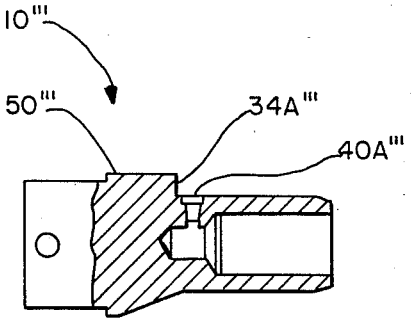
FIG. 10 is a sectional view of the nozzle assembly illustrated in FIG. 9, taken generally along line 10—10 in FIG. 9.

Referring to FIGS. 9 and 10, still another nozzle assembly embodiment 10''' is shown incorporating the same drag capability described above. This embodiment is identical to assembly 10, except that it includes a single step forming each arrangement of stepped surfaces. Each single step includes a single orifice 40A''' (see FIG. 10) and 40B''' (see FIG. 9). Note from FIG. 10 that the adjacent surface 34A''' is immediately behind and extends up from cooperating orifice 40A''' and that the outwardly facing surface 50''' extending rearwardly from surface 34A''' does not include an orifice and therefore does not include a cutting jet. As a result, surface 34A''' and its counterpart on the opposite side of the nozzle body serve as a drag for the entire nozzle assembly.

What is claimed is:

1. A nozzle assembly especially suitable for enlarging an inground passageway previously produced by a boring device, said nozzle assembly comprising a longitudinally extending nozzle body defining an interior cavity adapted to receive fluid under pressure from an external source and on one longitudinal side of the outer circumference of said body at least one arrangement of outwardly facing adjacent stepped surfaces including first surfaces facing in a direction perpendicular to and located progressively further from the longitudinal axis of said nozzle body starting with one of said first surfaces closest to a front longitudinal end of said body and second surfaces each of which is perpendicular to and directly behind an adjacent first surface with respect to the front longitudinal end of said body, and at least one orifice extending through each of said first surfaces and into said interior cavity, whereby to provide a plurality of longitudinally space fluid cutting jets perpendicular to the longitudinal axis of said nozzle body when said cavity contains said fluid under pressure for progressively enlarging said inground passageway by moving said nozzle body in a longitudinally extending forward direction through said passageway while the nozzle body is rotated about its longitudinal axis.

2. A nozzle assembly according to claim 1 wherein said stepped surfaces extend in a curved fashion around a part of the outer circumference of said nozzle body.

3. A nozzle assembly according to claim 2 wherein said nozzle body includes a second arrangement of stepped surfaces identical to said first-mentioned arrangement on the opposite side of the outer circumference of said nozzle body.

4. A nozzle assembly according to claim 1 wherein said nozzle body includes a second arrangement of stepped surfaces identical to said first-mentioned arrangement on the opposite side of the outer circumference of said nozzle body.

5. A nozzle assembly according to claim 4 wherein the outer circumference of said nozzle body includes a pair of flat surfaces located circumferentially between said arrangements of stepped surfaces on opposite sides of the nozzle body, each of said flat surfaces tapering outerwardly at an acute angle with the longitudinal axis of said nozzle body from a forward point on said body to a rearward point thereon.

6. A nozzle assembly according to claim 1 wherein said arrangement of stepped surfaces consists of two such steps including said first and second surfaces and therefore two of said cutting jets.

7. A nozzle assembly according to claim 1 wherein said arrangement of stepped surfaces consists of three such steps including said first and second surfaces and therefore three of said cutting jets.

8. A nozzle assembly according to claim 1 wherein said arrangement of stepped surfaces consists of four such steps including said first and second surfaces and therefore four of said cutting jets.

9. A nozzle assembly according to claim 1 including means located at a rearward end of said nozzle body for connecting the latter to cable means whereby to pull said cable means into the opening enlarged by said nozzle assembly as the latter is moved in said forward direction through said passageway.

10. A nozzle assembly especially suitable for enlarging an inground passageway previously produced by a boring device, said nozzle assembly comprising a longitudinally extending nozzle body defining an interior cavity adapted to receive fluid under pressure from an external source and on one longitudinal side of the outer circumference of said body at least one arrangement of outwardly facing adjacent stepped surfaces including at least one first surface facing in a direction perpendicular to and located a predetermined distance from the longitudinal axis of said nozzle body adjacent a front longitudinal end of said body and a second surface perpendicular to and directly behind each first surface, with respect to the front longitudinal end of said body and at least one orifice extending through each first surface and into said interior cavity whereby to provide a fluid cutting jet perpendicular to the longitudinal axis of said nozzle body when said cavity contains said fluid under pressure for progressively enlarging said inground passageway by moving said jet providing nozzle body through in a longitudinally extending forward direction through said passageway while the nozzle body is rotated about its longitudinal axis.

11. A nozzle assembly according to claim 10 wherein said nozzle body includes a second arrangement identical to said first-mentioned arrangement on the opposite side of the outer circumference of said nozzle body.

12. A nozzle assembly according to claim 11 wherein the outer circumference of said nozzle body includes a pair of flat surfaces located circumferentially between said arrangement of stepped surfaces on opposite sides of the nozzle body, each of said flat surfaces tapering outwardly at an acute angle with the longitudinal axis of said nozzle body from a forward point on said body to a rearward point thereon.

13. A nozzle assembly according to claim 12 wherein each said arrangement consists of a single step including said first and second surfaces.

14. A nozzle assembly according to claim 12 wherein each said arrangement includes two steps including said first and second surfaces.

15. A nozzle assembly especially suitable for enlarging an inground passageway previously produced by a boring device, said nozzle assembly comprising a longitudinally extending nozzle body defining an interior cavity adapted to receive fluid under pressure from an external source and on one longitudinal side of the outer circumference at said body at least one arrangement of outwardly facing adjacent stepped surfaces including at least one first surface facing in a direction substantially perpendicular to and located a predetermined distance from the longitudinal axis of said nozzle body adjacent a front longitudinal end of said body and a second surface substantially perpendicular to and directly behind each first surface with respect to the front longitudinal end of said body, and at least one orifice extending through each first surface and into said interior cavity, whereby to provide a fluid jet substantially perpendicular to the longitudinal axis of said nozzle body when said cavity contains said fluid under pressure for progressively enlarging said inground passageway by moving said jet providing nozzle body in a longitudinally extending forward direction through said passageway while the nozzle body is rotated about its longitudinal axis.

16. A nozzle assembly according to claim 15 wherein said nozzle body includes a second arrangement identical to said first-mentioned arrangement on the opposite side of the outer circumference of said nozzle body.

17. A nozzle assembly according to claim 16 wherein the outer circumference of said nozzle body includes a pair of flat surfaces located circumferentially between said arrangement of stepped surfaces on opposite sides of the nozzle body.

18. A nozzle assembly especially suitable for enlarging an inground passageway previously produced by a boring device, said nozzle assembly comprising a longitudinally extending nozzle body defining an interior cavity adapted to receive fluid under pressure from an external source and on one longitudinal side of the outer circumference of said body at least one arrangement of outwardly facing adjacent stepped surfaces extending in a curved fashion around a part of the outer circumference of said nozzle body and including first surfaces facing in a direction perpendicular to and located progressively further from the longitudinal axis of said nozzle body starting with one of said first surfaces closest to a front longitudinal end of said body and second surfaces each of which is perpendicular to and directly behind an adjacent first surface with respect to the front longitudinal end of said body, and at least one orifice extending through each of said first surfaces and into said interior cavity, whereby to provide a plurality of longitudinally space fluid cutting jets perpendicular to the longitudinal axis of said nozzle body when said cavity contains said fluid under pressure for progressively enlarging said inground passageway by moving said nozzle body in a longitudinally extending forward direction through said passageway while the nozzle body is rotated about its longitudinal axis, said nozzle body including a second arrangement of stepped surfaces identical to aid first-mentioned arrangement on the opposite side of the outer circumference of said nozzle body and the outer circumference of said nozzle body including a pair of flat surfaces located circumferentially between said arrangements of stepped surfaces on opposite sides of the nozzle body, each of said flat surfaces tapering outwardly at an acute angle with the longitudinal axis of said nozzle body from a forward point on said body to a rearward point thereon.

19. A nozzle assembly according to claim 18 wherein each arrangement of stepped surfaces consists of two such steps including said first and second surfaces.

20. A nozzle assembly according to claim 18 wherein each arrangement of stepped surfaces consists of three such steps including said first and second surfaces.

21. A nozzle assembly according to claim 18 wherein each arrangement of stepped surfaces consists of four such steps including said first and second surfaces.

* * * * *